US007389893B2

(12) United States Patent
Kasting

(10) Patent No.: US 7,389,893 B2
(45) Date of Patent: Jun. 24, 2008

(54) INVERTED DISPENSING PUMP

(75) Inventor: Thomas P. Kasting, Fort Wayne, IN (US)

(73) Assignee: Rieke Corporation, Auburn, IN (US)

( * ) Notice: Subject to any disclaimer, the term of this patent is extended or adjusted under 35 U.S.C. 154(b) by 366 days.

(21) Appl. No.: 10/659,462

(22) Filed: Sep. 10, 2003

(65) Prior Publication Data

US 2005/0051579 A1 Mar. 10, 2005

(51) Int. Cl.
*B65D 88/54* (2006.01)

(52) U.S. Cl. ..... 222/321.4; 222/321.9; 222/380; 222/384

(58) Field of Classification Search ..... 222/321.4–376, 222/384, 380, 321.9, 382, 481.5, 564
See application file for complete search history.

(56) References Cited

U.S. PATENT DOCUMENTS 2,774,517 A * 12/1956 Teegardin et al. ..... 222/205
3,379,136 A 4/1968 Corsette
4,118,152 A 10/1978 Bron
4,277,001 A * 7/1981 Nozawa ..... 222/321.4
4,286,736 A 9/1981 Corsette et al.
4,360,130 A 11/1982 Nishimura et al.
4,364,718 A 12/1982 Beun et al.
4,589,573 A 5/1986 Tada
4,673,109 A 6/1987 Cassia
4,775,079 A * 10/1988 Grothoff ..... 222/321.4
5,016,780 A * 5/1991 Moretti ..... 222/153.13
5,115,980 A * 5/1992 Skorka ..... 222/376
5,165,577 A 11/1992 Ophardt
5,282,552 A 2/1994 Ophardt
5,353,969 A 10/1994 Balderrama
5,373,970 A 12/1994 Ophardt
5,401,148 A * 3/1995 Foster et al. ..... 417/547

(Continued)

FOREIGN PATENT DOCUMENTS

DE 39 29 064 A 1/1991

(Continued)

OTHER PUBLICATIONS

Pictures of Umbrella Valve from RD Industries of Omaha, Nebraska (Pictures 1-6), Jan. 4, 2005.

(Continued)

*Primary Examiner*—Frederick C. Nicolas
(74) *Attorney, Agent, or Firm*—Woodard, Emhardt, Moriarty McNett & Henry LLP

(57) ABSTRACT

A fluid dispensing system includes a pump body configured to couple to a container. The pump body defines fluid inlet openings and a pump cavity. A shroud cover covers the pump body to draw fluid from the container. An inlet valve allows fluid from the container to enter the pump cavity through the fluid inlet openings. A plunger is slidably received in the pump cavity, and the plunger defines a fluid passage with a dispensing opening through which the fluid is dispensed. A shipping seal seals the fluid passage during shipping to minimize leakage of the fluid during shipping. An outlet valve is disposed inside the fluid passage to minimize the height of the fluid between the outlet valve and the dispensing opening so as to minimize dripping of fluid from the dispensing opening. The pump body includes a venting structure to normalize the air pressure inside the system.

19 Claims, 7 Drawing Sheets

U.S. PATENT DOCUMENTS

| | | | | |
|---|---|---|---|---|
| 5,431,309 | A | 7/1995 | Ophardt | |
| 5,445,288 | A | 8/1995 | Banks | |
| 5,489,044 | A | 2/1996 | Ophardt | |
| 5,676,277 | A | 10/1997 | Ophardt | |
| 5,738,250 | A * | 4/1998 | Gillingham et al. | 222/153.13 |
| 5,975,360 | A | 11/1999 | Ophardt | |
| 5,988,456 | A | 11/1999 | Laible | |
| 6,045,008 | A * | 4/2000 | Gonzalez Fernandez et al. | 222/321.9 |
| 6,082,586 | A | 7/2000 | Banks | |
| 6,126,042 | A | 10/2000 | Meshberg | |
| 6,343,724 | B1 | 2/2002 | Ophardt et al. | |
| 6,409,050 | B1 | 6/2002 | Ophardt et al. | |
| 6,516,976 | B2 | 2/2003 | Lewis et al. | |
| 6,533,145 | B2 | 3/2003 | Lewis et al. | |
| 6,540,117 | B2 | 4/2003 | Powling | |
| 6,540,157 | B2 | 4/2003 | Ophardt | |
| 6,543,651 | B2 | 4/2003 | Lewis et al. | |
| 6,557,736 | B1 | 5/2003 | Ophardt | |
| 6,575,334 | B2 | 6/2003 | Lewis et al. | |
| 6,575,335 | B2 | 6/2003 | Lewis et al. | |
| 6,601,736 | B2 | 8/2003 | Ophardt et al. | |
| 7,004,356 | B1 | 2/2006 | Sayers | |
| 7,011,237 | B1 | 3/2006 | Sayers et al. | |
| 2003/0201286 | A1 | 10/2003 | Ophardt | |
| 2004/0217137 | A1 | 11/2004 | Ophardt | |
| 2005/0224519 | A1 | 10/2005 | Law et al. | |
| 2007/0215164 | A1 | 9/2007 | Law et al. | |

FOREIGN PATENT DOCUMENTS

| | | | |
|---|---|---|---|
| EP | 0389688 | A1 | 10/1990 |
| EP | 0 703 831 | B1 | 12/1998 |
| EP | 1 190 775 | A1 | 3/2002 |
| EP | 1514607 | A2 | 3/2005 |
| JP | H08-011921 | A | 1/1996 |
| WO | 1999/049769 | A1 | 10/1999 |
| WO | 2003089152 | A1 | 10/2003 |

OTHER PUBLICATIONS

Hygiene-Technik Inc., A member of the Ophardt Group of Companies, UX10 Lotion or Foam Soap Dispenser, 2004, pp. 2.

European Patent Application 05256914.2 Extended Search Report mailed Mar. 2, 2006.

EP Patent Application 04 25 5318 Search Report mailed Jun. 14, 2006.

* cited by examiner

INVERTED DISPENSING PUMP

BACKGROUND

The present invention generally relates to fluid dispensing systems, and more specifically, but not exclusively, concerns a dispensing pump that minimizes leakage and increases of the amount of fluid that can be dispensed from a container.

Fluid dispensing pumps are used in a wide variety of situations. For example, in one common situation, the fluid dispensing pump can be a manually operated pump that is used to dispense liquid hand soap in restrooms. In the case of a fixed (i.e. wall mounted) dispensing pump, aesthetics and security come into play. Typically, the pump in a fixed installation is not readily accessible except by authorized personnel such that the fluid container and associated pumping mechanism are enclosed within a cabinet or docking station. The cabinet usually has some sort of manual actuator device, such as a button or lever that can be used to manually actuate the pump and dispense the fluid. Once the fluid container is emptied, the container can be replaced with a refill unit.

One typical pump design includes a fluid intake valve that controls the fluid flow from the container into the pump, a pumping mechanism such as a piston, and a dispensing port from which the fluid is dispensed. With fluid dispensing pumps, leakage is always a concern. The mess created by the leakage is at least unsightly, and more importantly, the leakage can create hazardous conditions. For example, leakage of liquid soap from a soap dispenser onto a floor can make the floor very slippery. Moreover, fluid leakage is always a concern throughout the life of the pump. When shipping the pump, internal container pressures can fluctuate as a result of temperature changes and/or handling shocks. In the first case, a temperature increase may cause the fluid in the container to expand or gases may out gas from the fluid, thereby increasing the pressure in a fixed volume container. At some point, the pressure inside the container can increase to a great enough level so as to unseat the fluid intake valve in the pump, thereby allowing the fluid to flow into the pump. If allowed to continue, the increased pressure in the pump will cause fluid to leak out the dispensing port of the pump. Once the fluid leaks out the dispensing port, the fluid can collect inside a shipping cap for the pump, if so equipped, and soil the external surfaces of the pump. In the second case, a hydraulic pressure pulse can be mechanically created inside the container by rough or even routine handling. For instance, the hydraulic pressure pulses can be created through container vibration, the container being dropped, and/or through container impact. The hydraulic pressure pulses created through handling can have much of the same affect upon the pump as with temperature changes described above, thereby causing leakage.

Leakage of fluid from the pump can occur through other sources as well. As an illustration, one leakage source in a typical fluid pump comes from fluid remaining within the dispensing port after routine use. As one should appreciate from using hand soap dispensers, the liquid soap remaining in the dispensing port tends to drip and pool on the countertop or the floor. Many factors affect this type of leakage, such as viscosity of the fluid, surface tension, diameter of the dispensing port, and height of the fluid in the dispensing port. Any product residing within the dispensing port will have a certain associated weight. The weight of the fluid in the dispensing port imparts a force, known as head pressure, against the surface tension of the fluid that bridges the opening of the dispensing port. As should be appreciated, the greater the height of the fluid in the dispensing port, the greater weight of the fluid that bears against the surface tension of the fluid at the dispensing port. The greater weight of the fluid in the dispensing port gradually overcomes the surface tension at the opening of the dispensing port. The surface of the fluid at the opening will stretch and bulge beyond the opening of the dispensing port, thereby forming a droplet. At some point the droplet will break free as a result of an external vibration and/or the inability of the fluid to withstand the higher head pressure imparted by the greater weight.

Another leakage source can be caused by the dispensing of fluid. As fluid is dispensed from the container, a vacuum can form inside the container. Left unaddressed, the vacuum inside the container can distort the container, which in turn can cause cracks in the container and subsequent leakage from the cracks. Conceivably, even if no leakage occurs, the vacuum inside the container can become great enough to overcome the ability of the pump to dispense fluid or at the least reduce dispensing dosages.

Another factor in dispensing pump design is the need to have the pump evacuate as much of the contents in the container as possible so as to minimize waste. Typically, in order to minimize the overall container height for shipping purposes, a significant portion of the pump is placed inside the container. For inverted type pumps as well as other type pumps, this arrangement limits the amount of fluid that can be evacuated from the container since the fluid can only be drawn down to the level of the intake valve, which is positioned well inside the container. As a result, the fluid remaining in the container below the inlet valve is wasted.

Thus, needs remain for further contributions in this area of technology.

SUMMARY OF THE INVENTION

One aspect of the present invention concerns a fluid dispensing system. The system includes a pump body that is constructed and arranged to couple to a container. The pump body defines a fluid inlet opening and a pump cavity. An inlet valve is constructed and arranged to allow fluid from the container to enter the pump cavity through the fluid inlet opening. A plunger is slidably received in the pump cavity, and the plunger defines a fluid passage through which the fluid is dispensed. A shipping seal seals the fluid passage to minimize leakage of the fluid before use.

Another aspect concerns a fluid dispensing system. The system includes a pump body that is constructed and arranged to couple to a container. The pump body defines a fluid inlet opening inside the container and a pump cavity. A plunger is slidably received in the pump cavity to draw fluid from the container into the pump cavity. An intake shroud covers the inlet opening, and the shroud includes a flow channel to draw fluid from the container into the inlet opening.

A further aspect concerns a fluid dispensing system. The system includes a pump body that defines a pump cavity. A plunger is slidably received in the pump cavity, and the plunger defines a fluid passage with a dispensing opening from which fluid is dispensed. An outlet valve is disposed inside the fluid passage to minimize dripping of the fluid from the dispensing opening.

Further forms, objects, features, aspects, benefits, advantages, and embodiments of the present invention will become apparent from a detailed description and drawings provided herewith.

DESCRIPTION OF THE SELECTED EMBODIMENTS

Figure 1:
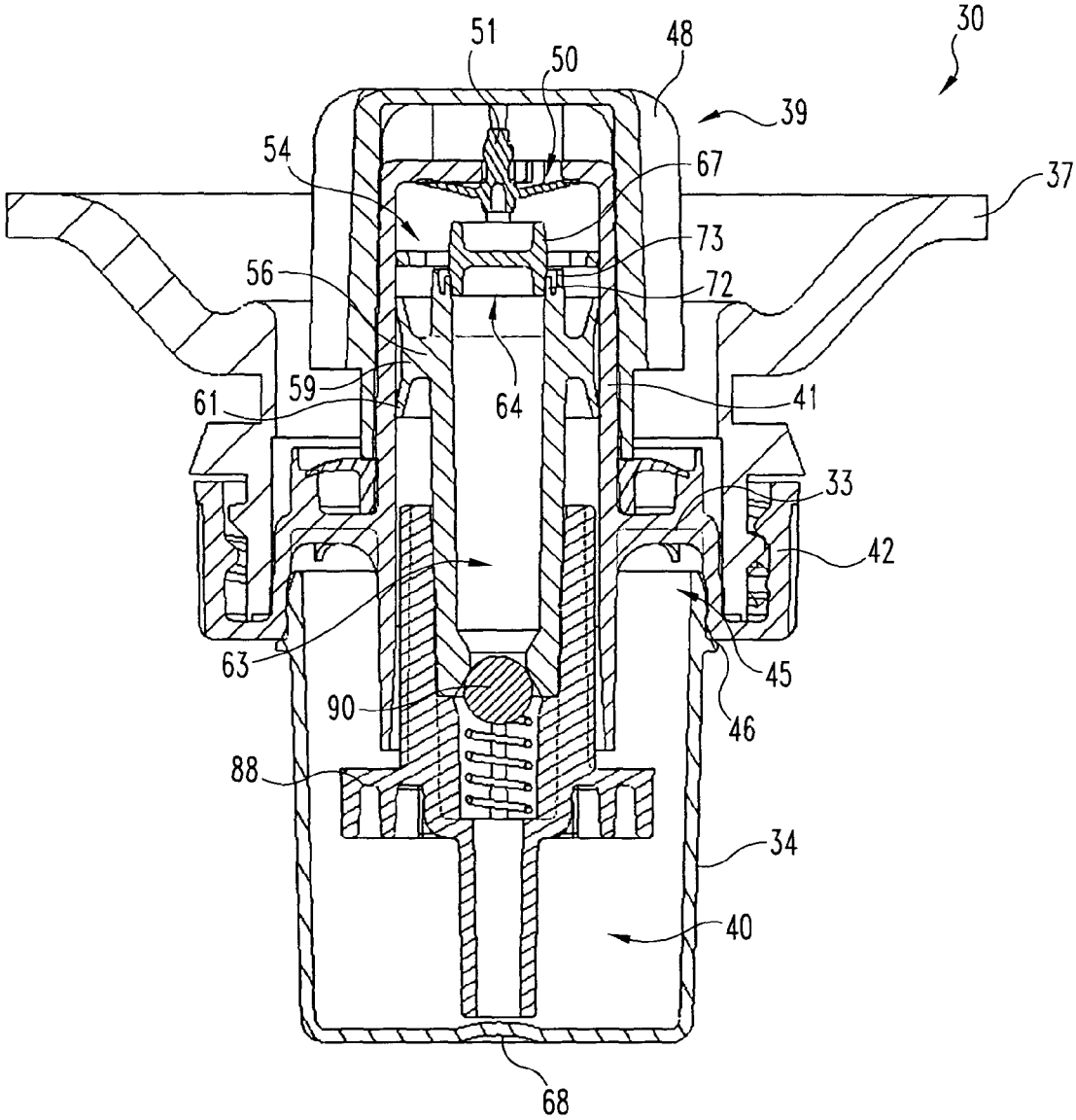
FIG. 1 is a cross sectional view, in full section, of a fluid dispensing system, according to one embodiment of the present invention, oriented in a shipping configuration.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the art that some features that are not relevant to the present invention may not be shown for the sake of clarity.

A fluid dispensing system 30 according to one embodiment, among many embodiments, is illustrated in FIG. 1. The dispensing system 30 includes a fluid pump 33 and a transit cap 34 engaged to the pump 33 in order to promote cleanliness as well as to protect the pump 33 during shipping and/or storage. The dispensing system 30 in the illustrated embodiment is used as a refill (or initial) fluid supply for a fixed manual pump, such as for soap dispensers. It nonetheless should be appreciated that the dispensing system 30 can be used to dispense other types of fluids and also can be used in conjunction with other types of pumping systems. During use, the dispensing system 30 is housed within a cabinet or docking station that has a spring biased lever or other type of actuation member for actuating the pump 33 to dispense fluid. Once emptied, the dispensing system 30 can be removed from the docking station and replaced with another. In the illustrated embodiment, the pump 33 is an inverted type manual pump. However, it is contemplated that features of the present invention can be adapted for use with other types of pumps. As shown, the pump 33 is threadedly engaged to a container 37. Although not illustrated, it should be appreciated that the container 37 is closed so as to hold a fluid. In one form, the container 37 is a bottle. Nevertheless, it should be appreciated that the container 37 can include other types of containers as would occur to those skilled in the art.

As illustrated in FIG. 1, the pump 33 has a fluid intake end portion 39 that is received inside the container 37 and a fluid dispensing end portion 40 that extends from the container 37. In the illustrated embodiment, the pump 33 is generally cylindrical in shape, but it is contemplated that the pump 33 can have a different overall shape in other embodiments. The pump 33 includes a pump body 41 with a threaded container engagement flange 42 that threadedly engages the container 37. Inside the container engagement flange 42, the pump body 41 defines a cap engagement cavity 45 with a cap retention lip 46 (FIG. 2) that detachably retains the cap 34 in the cap engagement cavity 45 during transit and/or storage. At the fluid intake end portion 39, an intake shroud 48 covers the pump body 41. As will be described in greater detail below, the intake shroud 48 is used to increase the amount of fluid that can be dispensed from the container 37. Inside the intake shroud 48, the pump body 41 defines one or more fluid inlet openings 50 through which fluid is supplied to the pump 33. An inlet valve 51 covers and seals the inlet openings 50 during the dispensing stroke of the pump 33. The inlet valve 51 acts as a check valve so that the fluid is only able to flow in one direction, that is into the pump 33. In the illustrated embodiment, the inlet valve 51 includes an umbrella type valve. However, it is contemplated that in other embodiments the inlet valve 51 can include other types of flow control valves.

Figure 2:
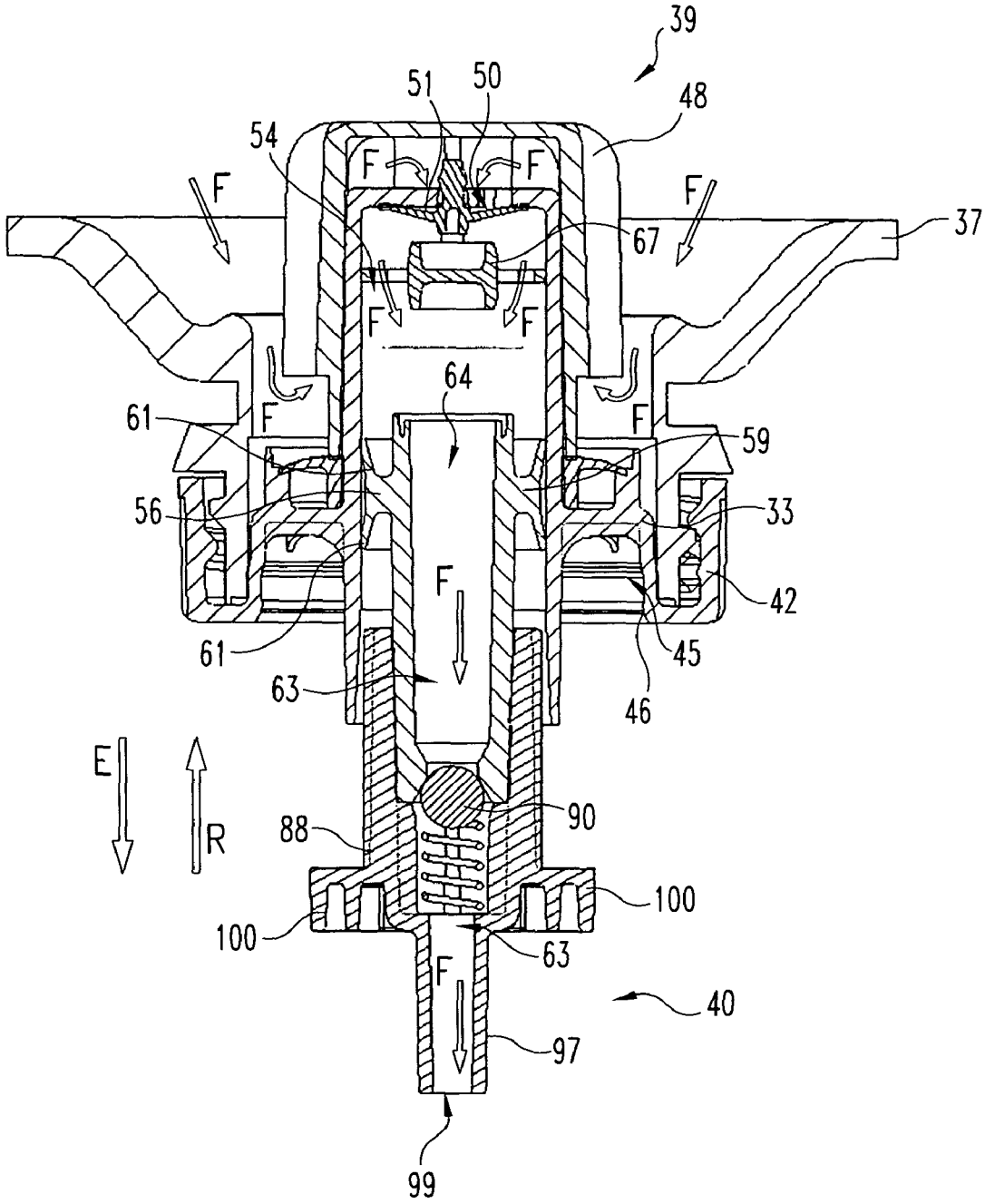
FIG. 2 is a cross sectional view, in full section, of the FIG. 1 fluid dispensing system oriented in a dispensing configuration.

Referring to FIGS. 1 and 2, the pump body 41 defines a pump cavity 54 in which a piston or plunger member 56 is slidably received. The plunger 56 has a plunger seal 59 that engages the walls of the pump cavity 54 in a sealing manner. As shown in the illustrated embodiment, the plunger seal 59 includes a pair of opposing plunger flaps or lips 61 that extend and seal around the plunger 56. A fluid passage 63 is defined inside the plunger 56, and the fluid passage 63 has at least one plunger opening 64 through which the fluid flows when being dispensed. During shipping and/or before use, the plunger 56 is retracted inside the pump cavity 54 so that the plunger opening 64 is plugged with a shipping seal 67, as is illustrated in FIG. 1. Friction between the flaps 61 and the pump body 41 helps to retain the plunger 56 in the retracted position during shipping. The transit cap 34 can also retain the plunger 56 in the retracted or shipping position by including features, such as a dimple 68, that aid in retaining the plunger 56 in the retracted position.

Figure 4:
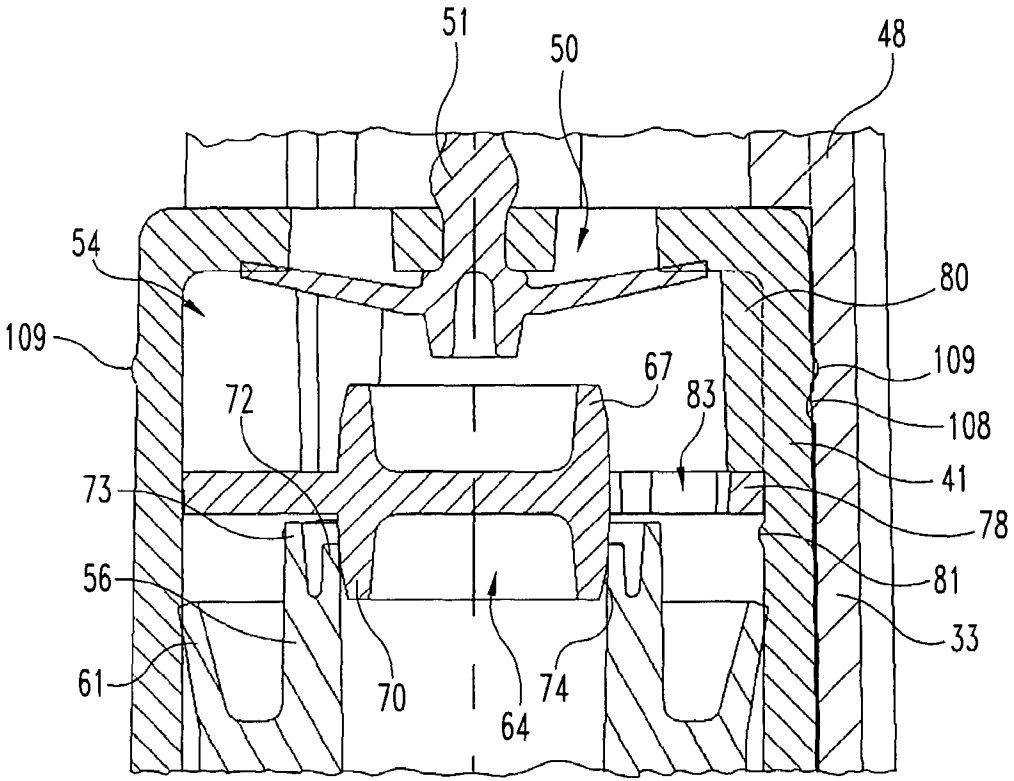
FIG. 4 is an enlarged cross sectional view of a fluid inlet end of the FIG. 1 fluid dispensing system.
Figure 3:
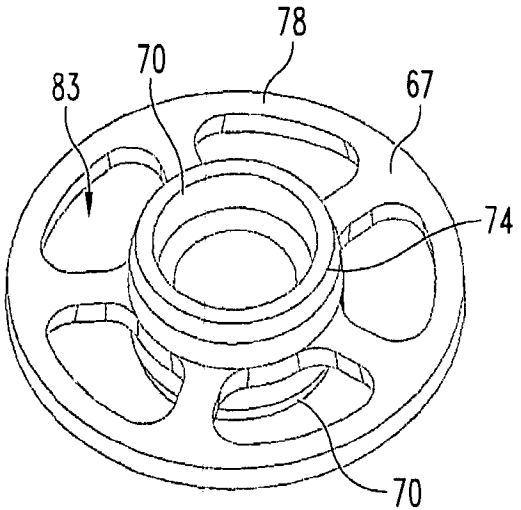
FIG. 3 is a perspective view of a shipping seal used in the FIG. 1 fluid dispensing system.

As discussed above, an increase in pressure in the container 37, caused for example by increased temperatures and/or vibrations, can create pump leakage during shipping or storage. The shipping seal 67 according to the present invention minimizes this type of fluid leakage from the pump 33. Referring to FIGS. 3 and 4, the shipping seal 67 includes a seal member 70 that is closed to seal the plunger opening 64. In the illustrated embodiment, the shipping seal 67 has two seal members 70 extending from opposite sides so that the shipping seal 67 can be easily installed, regardless which side of the shipping seal 67 faces the plunger 56. However, it should be understood that the shipping seal 67 can include more or less seal members 70 than is illustrated. For example, when the plunger 56 has more than one plunger opening 64, the pump 33 can include more than one seal member 70 and/or more than one shipping seal 67 to seal the corresponding plunger openings 64. As depicted in FIG. 4, the plunger 56 has an inner seal ridge 72 positioned inside an outer ridge 73, and the seal member 70 seals inside the inner seal ridge 72. The seal member 70 has a beveled seal edge 74 that centers the seal member 70 within the inner seal ridge 72. As should be appreciated, the seal member 70 in other embodiments can seal the plunger opening 64 in other manners. Surrounding the seal member 70, the shipping seal 67 has a support flange 78 that engages the pump body 41, as illustrated in FIGS. 3 and 4. The pump body 41 has one or more standoff members 80 and one or more snap beads 81 extending inside the pump cavity 54, between which the support flange 78 is secured. With reference to FIG. 3, the support flange 78 of the shipping seal 67 defines one or more flow openings 83 through which fluid flows when being dispensed.

Having the shipping seal 67 seal the plunger opening 64 during transit minimizes the risk of fluid leakage from the pump 33, even if fluid leaks past the inlet valve 51. Once the pump 33 is ready for use, the transit cap 34 is removed so that the plunger 56 can be extended, as is depicted in FIG. 2, thereby disengaging the shipping seal 67 from the plunger opening 64. As soon as the shipping seal 67 disengages from the plunger 56, the fluid is able to flow into the fluid passage 63 in the plunger 56. Fluid flow arrows F in FIG. 2 illustrate the overall flow path of the fluid when dispensed from the pump 33, after the shipping seal 67 is disengaged.

Figure 5:
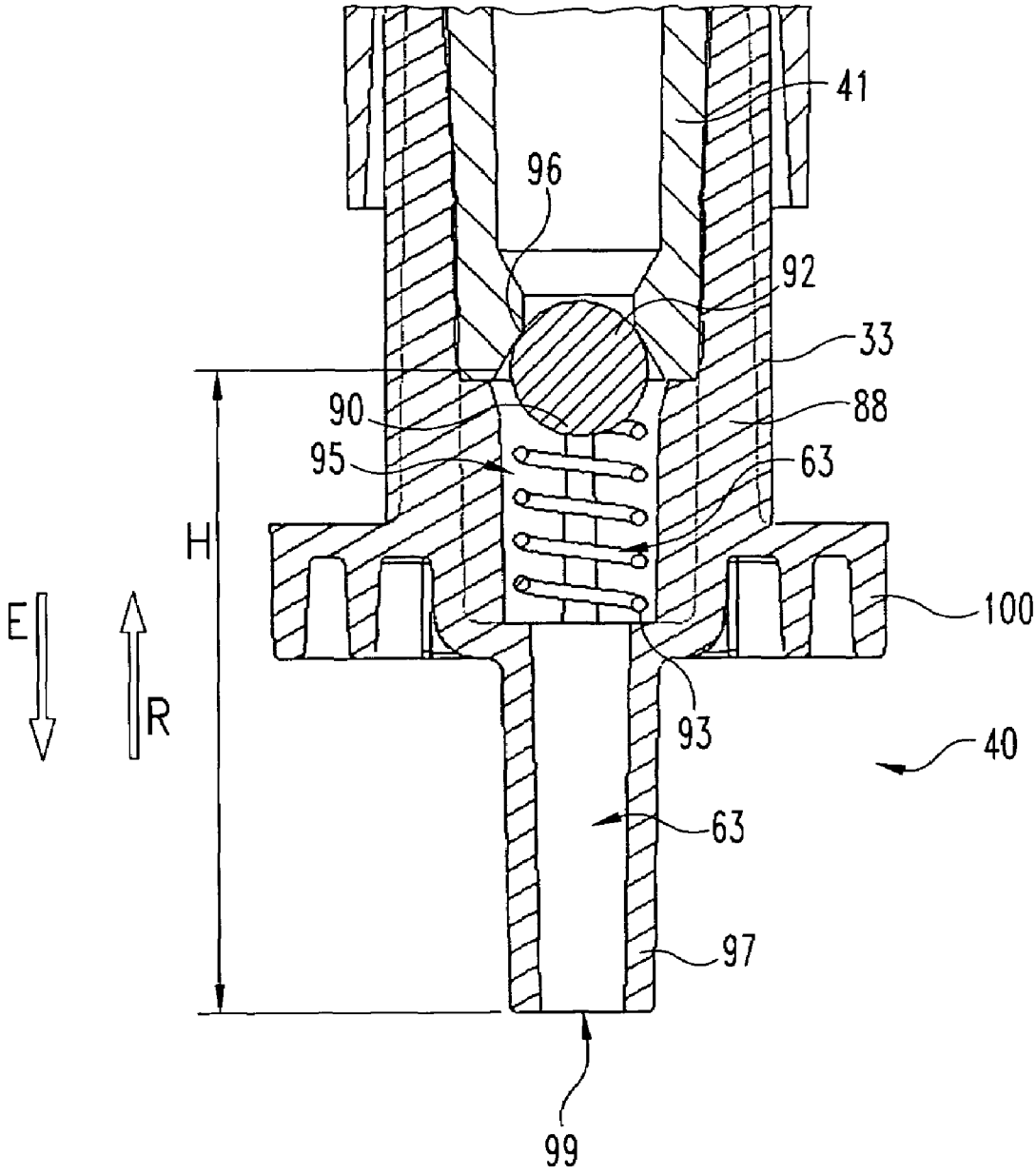
FIG. 5 is an enlarged cross sectional view of a fluid dispensing end of the FIG. 1 fluid dispensing system.

Further, the pump 33 is configured to minimize fluid leaking or dripping from the pump 33 between dispenses. Referring to FIG. 2, a dispensing port 88 is coupled to the pump body 41 at the fluid dispensing end portion 40 of the pump 33. The fluid passage 63 in the plunger 56 further extends into the dispensing port 88. Inside the fluid passage 63, at the interface between the plunger 56 and the dispensing port 88, the pump 33 has an outlet valve 90 that controls the flow of the fluid from the pump 33. The outlet valve 90 in the illustrated embodiment is a check valve that allows the fluid to only flow out of the dispensing port 88. In FIG. 5, the illustrated outlet valve 90 includes a valve member 92, which is spherical or ball-shaped, and a spring 93 for biasing the valve member 92 into a normally closed position. As shown, the dispensing port 88 defines a valve cavity 95 in which the outlet valve 90 is received, and the plunger 56 has a valve seat 96 against which the valve member 92 seals. Downstream from the outlet valve 90, along the fluid passage 63, the dispensing port 88 has a dispensing tip 97 with a dispensing opening 99 through which fluid from the fluid channel 63 is dispensed. As should be appreciated, by positioning the outlet valve 90 inside the fluid passage 63 of the dispensing port 88, height H of fluid between the dispensing opening 99 and the valve member 90 can be minimized. Depending on many factors, including the properties of the fluid being dispensed, such as viscosity, the height H of the fluid inside the dispensing tip 97 can be adjusted so that the surface tension of the fluid at the dispensing opening 99 will be able to easily support the weight of the fluid within the dispensing tip 97, thereby reducing the chance that fluid will drip from the dispensing opening 99.

The dispensing port 88 further incorporates a dispensing flange 100 that is configured to engage an actuation mechanism, such as lever, inside the docking station or cabinet to which the dispensing system 30 is mounted. With reference to FIGS. 2 and 5, during dispensing, the dispensing port 88 along with the plunger 56 are pushed in a retraction direction R into the pump cavity 54. As the plunger 56 moves in direction R, the inlet valve 51 closes the inlet openings 50, and the pressure of the fluid inside the fluid passage 63 causes outlet valve 90 to open. Once the outlet valve 90 opens, the fluid is dispensed from the dispensing opening 99. To refill the pump cavity 54 with fluid for the next dispensing stroke, the dispensing port 88 along with the plunger 56 are pulled in extension direction E to extend from the pump 33. In one type of installation, the actuation mechanism, such as a lever in the docking station or cabinet, has a spring that biases the dispensing port 88 in the extension direction E. It is contemplated that in other types of installations the dispensing port 88 can manually or automatically moved in the extension direction E. As the plunger 56 extends in direction E, the outlet valve 90 closes and the inlet valve 51 opens, thereby allowing the fluid to flow into and fill the pump cavity 54 for subsequent dispensing.

As mentioned above, in order to lower the overall profile of the dispensing system 33, the fluid intake end portion 39 of the pump 33 extends inside the container 37. However, by positioning the fluid intake end portion 39 of the pump 33 inside the container other design concerns are created. For instance, as depicted in FIGS. 1 and 2, the inlet openings 50 are positioned deeper inside the container 37 such that any fluid below the inlet openings 50 will never be dispensed, and thus, wasted. Not only is cost of the wasted fluid a concern, but also the labor costs associated with the increased replacement frequency of the dispensing system 33 may be an even greater concern. Although the inlet openings 50 can be positioned at a lower position on the pump body 41, the ultimate location of the fluid inlet openings 50 is still limited by position of the plunger 56. The inlet openings 50 need to be located so that the plunger 56 is able to draw the fluid. As briefly noted above, the intake shroud 48 is able to increase the evacuation efficiency of the pump 33. By way of analogy, the intake shroud 48 acts like a straw to draw fluid in the neck of the container 37 that is below the inlet openings 50 through the inlet openings 50 and into the pump cavity 54.

Figure 7:
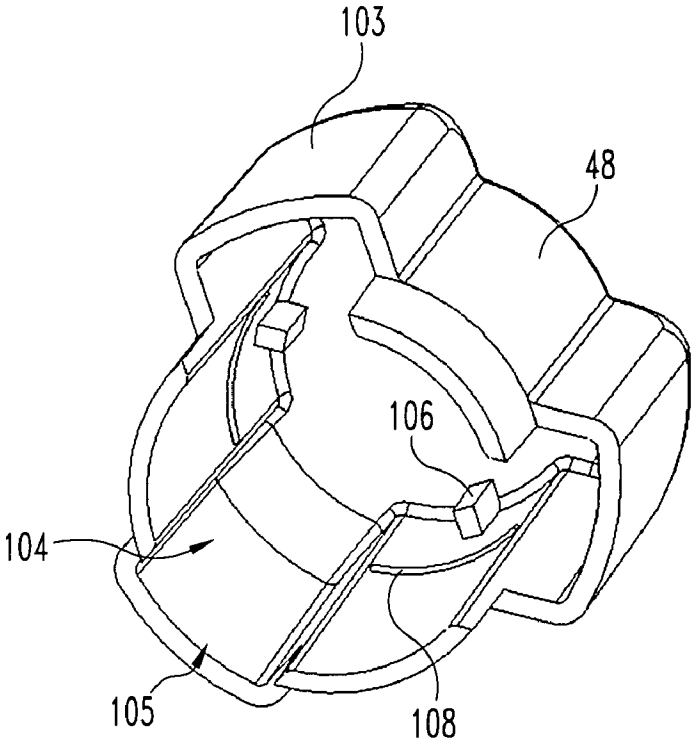
FIG. 7 is a bottom perspective view of the FIG. 6 intake shroud.
Figure 6:
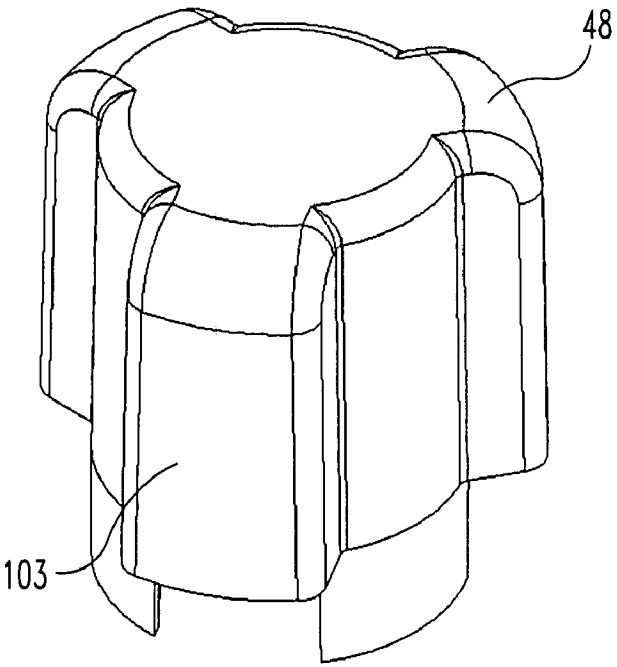
FIG. 6 is a top perspective view of an intake shroud used in the FIG. 1 fluid dispensing system.
Figure 8:
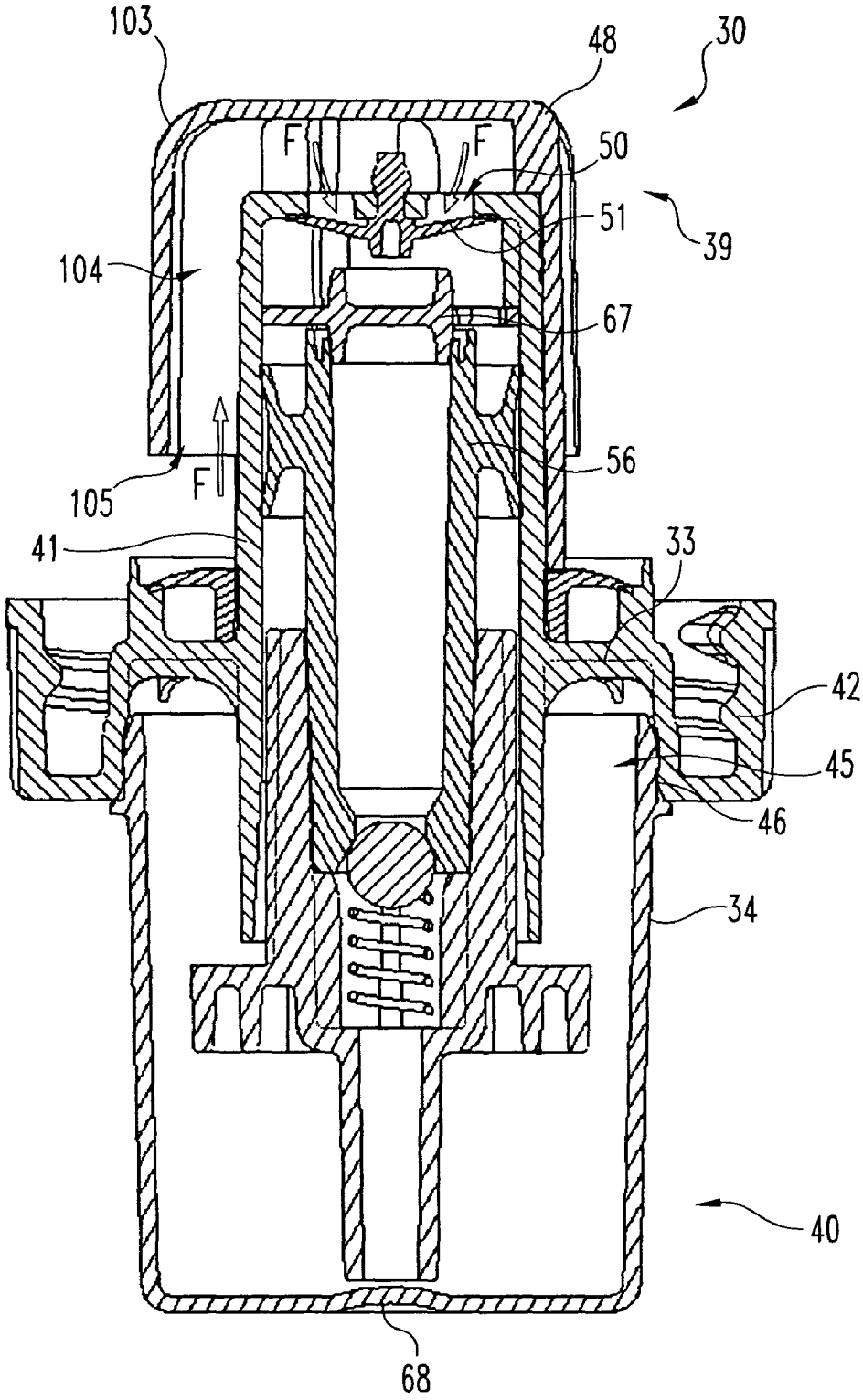
FIG. 8 is a cross sectional view, in full section, of the FIG. 1 fluid dispensing system illustrating a flow channel in the FIG. 6 intake shroud.
Figure 9:
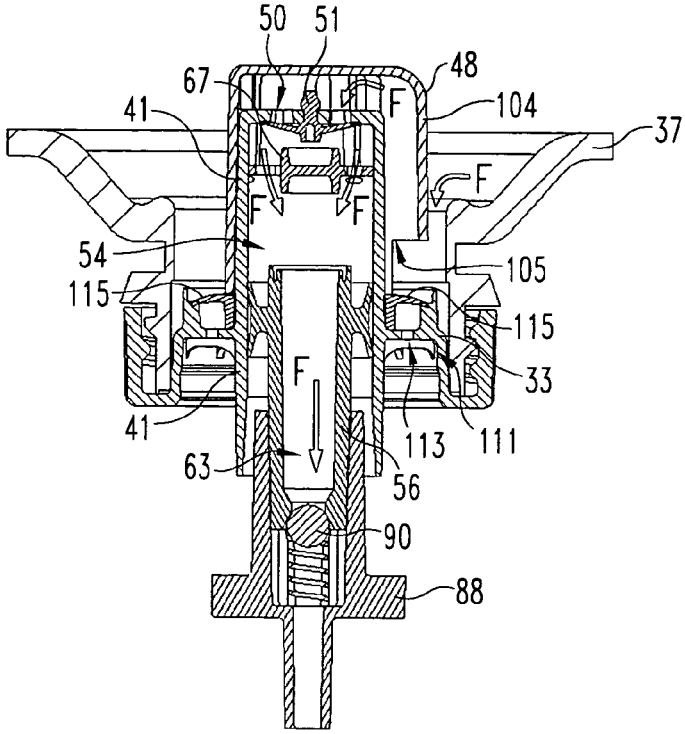
FIG. 9 is a cross sectional view, in full section, of the FIG. 1 fluid dispensing system illustrating a venting structure in the FIG. 1 fluid dispensing system.

With reference to FIGS. 6 and 7, the intake shroud 48 has one or more flow members 103 that define one or more flow channels 104 with channel openings 105, through which fluid is drawn from the container 37 and into the pump 33. Inside the intake shroud 48, one or more shroud standoffs 106 space the intake shroud 48 from the pump body 41 so as to allow the fluid to flow between the intake shroud 48 and the pump body 41. Further, the intake shroud 48 has one or more body engagement snap beads 108 that are configured to secure the intake shroud 48 onto the pump body 41. As illustrated in FIG. 4, the body engagement snap beads 108 engage one or more shroud engagement snap beads 109 on the pump body 41 so that the intake shroud 48 is secured to the rest of the pump 33. As shown in FIGS. 8 and 9, once the intake shroud 48 is secured, the flow channels 104 extend along the pump body 41 towards the fluid dispensing end portion 40 of the pump 33. The channel openings 105 of the flow channels 104 open below the fluid inlet openings 50 so as to increase the amount of fluid that is able to be evacuated from the container 37. With the intake shroud 48 secured in such a manner, the fluid below the inlet openings 50 is able to flow into the pump 33 through the flow channels 104, as depicted with fluid flow arrows F.

Figure 10:
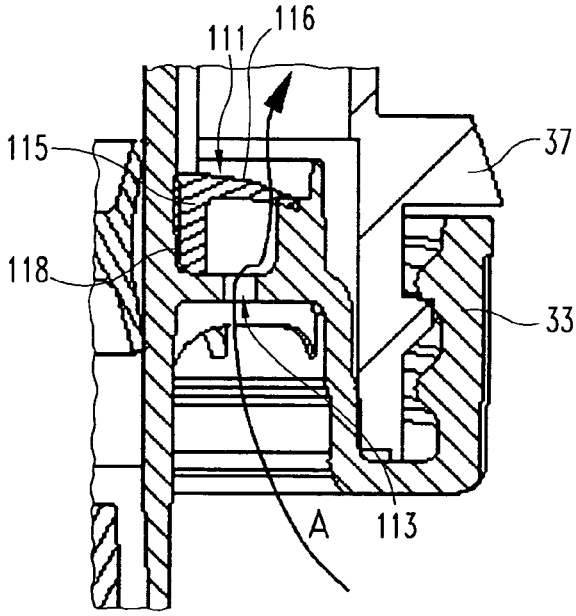
FIG. 10 is an enlarged cross sectional view of the FIG. 9 venting structure.

As previously discussed, when fluid is pumped from the container 37, a vacuum (i.e., low pressure) can be formed inside the container 37 as a result of the fluid being removed from the container 37. If left unchecked, the vacuum can distort the container 37 such that cracks can form in the container 37, and these cracks can create a leakage source. Referring to FIG. 9, the pump 33 has a venting structure 111 that is configured to equalize the air pressure inside the container 37 with ambient conditions while at the same time prevent fluid leakage from the dispensing system 30. The venting structure 111, according to the illustrated embodiment, includes one or more vent openings 113 defined in the pump body 41 and at least one vent seal 115 positioned to seal the vent openings 113. As shown in FIG. 10, the vent seal 115 is sandwiched between the intake shroud 48 and the vent body 41. In one form, the vent seal 115 is ring-shaped and includes a vent flap 116 that extends from a body portion 118. When a vacuum forms inside the container 37, the vent flap 116 is able to deflect and allow air (or some other gas) flow into the container 37 to alleviate the vacuum, as is indicated by air flow arrow A in FIG. 10. Once the pressure is equalized, the vent flap 116 of the vent seal 115 reseals the vent openings 113 to prevent fluid leakage from the vent openings 113.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by following claims are desired to be protected. All publications, patents, and patent applications cited in this specification are herein incorporated by reference as if each individual publication, patent, or patent application were specifically and individually indicated to be incorporated by reference and set forth in its entirety herein.

What is claimed is:

1. A fluid dispensing system, comprising:

a pump body constructed and arranged to couple to a container, the pump body defining a fluid inlet opening and a pump cavity;

an inlet valve constructed and arranged to allow fluid from the container to enter the pump cavity through the fluid inlet opening;

a plunger slidably received in the pump cavity, the plunger defining a fluid passage through which the fluid is dispensed; and a shipping seal sealing the fluid passage to minimize leakage of the fluid before use, the shipping seal including at least two seal members constructed and arranged to seal inside the fluid passage in the plunger, the at least two seal members extending from opposite sides of the shipping seal so that the shipping seal can be installed regardless of which side of the shipping seal faces the plunger.

2. The system of claim 1, further comprising an outlet valve disposed inside the fluid passage to minimize fluid leakage between dispenses.

3. The system of claim 2, wherein the outlet valve includes a check valve.

4. The system of claim 2, wherein the outlet valve includes a valve member and a spring engaging the valve member to bias the valve member into a normally closed position.

5. The system of claim 1, further comprising a shroud member covering the inlet opening to draw fluid from the container.

6. The system of claim 1, further comprising a venting structure to equalize air pressure inside the container.

7. The system of claim 6, wherein the venting structure includes a vent opening defined in the pump body and a vent valve sealing the vent opening to allow air passage into the container.

8. The system of claim 1, wherein the shipping seal is constructed and arranged to seal the fluid passage when the plunger is fully retracted and to allow fluid flow into the fluid passage when the plunger is extended.

9. The system of claim 1, wherein the shipping seal includes:

a support flange engaging the pump body from where the at least two seal members extend; and a flow opening defined in the support flange to allow passage of fluid into the fluid passage.

10. The system of claim 9, wherein the at least two seal members each includes a beveled edge.

11. A fluid dispensing system, comprising:

a fluid pump constructed and arranged to dispense fluid from a container, the fluid pump including a fluid intake end portion and a fluid dispensing end portion;

the fluid intake end portion being configured to extend within the container when the fluid pump is coupled to the container to lower overall profile of the fluid dispensing system;

the fluid intake end portion having a pump body with an inlet opening where the fluid from the container is drawn into the fluid pump;

the fluid dispensing end portion being configured to extend outside the container when the fluid pump is coupled to the container;

the fluid dispensing end portion having a dispensing opening where the fluid is dispensed from the fluid pump;

an intake shroud covering the inlet opening, the shroud including a flow member that defines in part a flow channel with a channel opening configured to draw fluid from the container into the inlet opening;

the flow channel of the shroud extending from the fluid intake end portion towards the fluid dispensing end portion, wherein the channel opening is located along the fluid pump between the inlet opening and the fluid dispensing end portion to increase evacuation efficiency of the fluid from the container;

the shroud including one or more shroud standoffs that space the shroud from the pump body; and the flow channel being defined between the flow member and the pump body.

12. The system of claim 11, further comprising the container.

13. The system of claim 11, further comprising a shipping seal disposed inside the pump cavity to minimize fluid leakage during shipping.

14. The system of claim 11, further comprising a venting structure defined in the fluid pump to equalize air pressure inside the container.

15. The system of claim 11, further comprising:

a plunger slidably disposed in the fluid pump for pumping the fluid, wherein the plunger defines a fluid passage that dispenses the fluid; and an outlet valve disposed inside the fluid passage to minimize fluid leakage between dispenses.

16. The system of claim 11, wherein the fluid pump includes an inlet valve at the inlet opening, wherein the shroud allows fluid to be drawn to the inlet valve.

17. A fluid dispensing system, comprising:

a fluid pump constructed and arranged to dispense fluid from a container, the fluid pump including a fluid intake end portion and a fluid dispensing end portion;

the fluid intake end portion being configured to extend within the container when the fluid pump is coupled to the container to lower overall profile of the fluid dispensing system;

the fluid intake end portion having an inlet opening where the fluid from the container is drawn into the fluid pump;

the fluid dispensing end portion being configured to extend outside the container when the fluid pump is coupled to the container;

the fluid dispensing end portion having a dispensing opening where the fluid is dispensed from the fluid pump;

an intake shroud covering the inlet opening, the shroud including a flow channel with a channel opening configured to draw fluid from the container into the inlet opening;

the flow channel of the shroud extending from the fluid intake end portion towards the fluid dispensing end portion, wherein the channel opening is located along the fluid pump between the inlet opening and the fluid dispensing end portion to increase evacuation efficiency of the fluid from the container wherein the container is inverted and has a neck where the fluid pump is coupled to the container;

wherein the fluid pump is an inverted dispensing pump;

wherein the channel opening of the shroud opens at a position below the inlet opening in the neck of the container to draw the fluid in the neck that is located below the inlet opening; and a vent opening defined in the pump body to vent air into the container and a vent seal to seal the vent opening.

18. A fluid dispensing system, comprising:

an inverted dispensing pump configured to secure to a neck of a container that is inverted during dispensing of fluid from the container;

the inverted dispensing pump including a pump body with an inlet opening where the fluid from the container is drawn into the inverted dispensing pump;

a shroud covering the inlet opening of the inverted dispensing pump, the shroud including a flow member that defines a flow channel with a channel opening that opens at a position below the inlet opening in the neck of the container during pumping to draw the fluid in the neck of the container that is below the inlet opening into the inverted dispensing pump, wherein the flow channel is defined between the flow member and the pump body;

the shroud having a standoff that spaces the shroud from the pump body to allow the fluid to flow between the shroud and the pump body; and the shroud having a body engagement snap bead that secures the shroud to the pump body.

19. The fluid dispensing system of claim 18, comprising:

the container secured to the inverted dispensing pump.

* * * * *

UNITED STATES PATENT AND TRADEMARK OFFICE

CERTIFICATE OF CORRECTION

PATENT NO. : 7,389,893 B2
APPLICATION NO. : 10/659462
DATED : June 24, 2008
INVENTOR(S) : Kasting It is certified that error appears in the above-identified patent and that said Letters Patent is hereby corrected as shown below:

Title Page, Item (56) Ref. Cited:

On Page 2, Column 2, please change "2007/0215164 A1 9/2007 Law et al." to --2007/0215643 A1 2/2008 Law et al.--

Signed and Sealed this

Twenty-sixth Day of August, 2008

JON W. DUDAS
*Director of the United States Patent and Trademark Office*